US008281777B2

(12) United States Patent
Bach et al.

(10) Patent No.: US 8,281,777 B2
(45) Date of Patent: Oct. 9, 2012

(54) BOW STRING VIBRATION DAMPENING SIGHT

(75) Inventors: Jon C. Bach, Frenchtown, NJ (US); Richard S. Chomik, Doylestown, PA (US)

(73) Assignee: Accuracy In Motion Outdoors LLC, Hampton, NJ (US)

( * ) Notice: Subject to any disclaimer, the term of this patent is extended or adjusted under 35 U.S.C. 154(b) by 516 days.

(21) Appl. No.: 12/369,618

(22) Filed: Feb. 11, 2009

(65) Prior Publication Data

US 2009/0223502 A1 Sep. 10, 2009

Related U.S. Application Data

(60) Provisional application No. 61/027,785, filed on Feb. 11, 2008.

(51) Int. Cl.
*F41G 1/467* (2006.01)

(52) U.S. Cl. ..... 124/87; 124/90; 124/92

(58) Field of Classification Search ..... 124/87, 124/90, 91, 92; 492/56
See application file for complete search history.

(56) References Cited

U.S. PATENT DOCUMENTS

| | | | | | |
|---|---|---|---|---|---|
| 295,252 | A | | 3/1884 | Hutchins | |
| 2,023,438 | A | * | 12/1935 | Ray | 492/56 |
| 2,773,300 | A | * | 12/1956 | Clements | 492/16 |
| 3,410,644 | A | | 11/1968 | McLendon | |
| 3,703,771 | A | | 11/1972 | Saunders | |
| 4,011,853 | A | * | 3/1977 | Fletcher | 124/87 |
| 4,656,747 | A | | 4/1987 | Troncoso | |
| 4,965,938 | A | | 10/1990 | Saunders | |
| 5,542,186 | A | | 8/1996 | Saunders | |
| 5,669,146 | A | | 9/1997 | Beutler | |
| 5,860,408 | A | | 1/1999 | Summers | |
| 5,996,569 | A | | 12/1999 | Wilson | |
| RE36,555 | E | * | 2/2000 | Tentler | 124/91 |
| 6,131,295 | A | | 10/2000 | Cranston | |
| 6,343,600 | B1 | * | 2/2002 | Steinman | 124/91 |
| 6,761,158 | B2 | * | 7/2004 | Wright | 124/92 |
| 7,275,327 | B2 | | 10/2007 | Deien | |

* cited by examiner

*Primary Examiner* — John Ricci
(74) *Attorney, Agent, or Firm* — Kelley, Drye & Warren LLP

(57) ABSTRACT

An archery peep sight is disclosed that combines integrally a bowstring dampener and a peep sight.

9 Claims, 5 Drawing Sheets

BOW STRING VIBRATION DAMPENING SIGHT

This application claims benefit of U.S. Provisional Application Ser. No. 61/027,785, filed Feb. 11, 2008, the entire content of which is incorporated herein in its entirety.

BACKGROUND OF THE INVENTION

1. Field of the Invention

The present invention generally relates to archery sighting systems and more specifically to peep sights, and in one non-limiting embodiment to improved peep sights that integrally provide vibration dampening or silencing as well as sighting ability for archery systems.

2. Description of the Related Art

Figure 1:
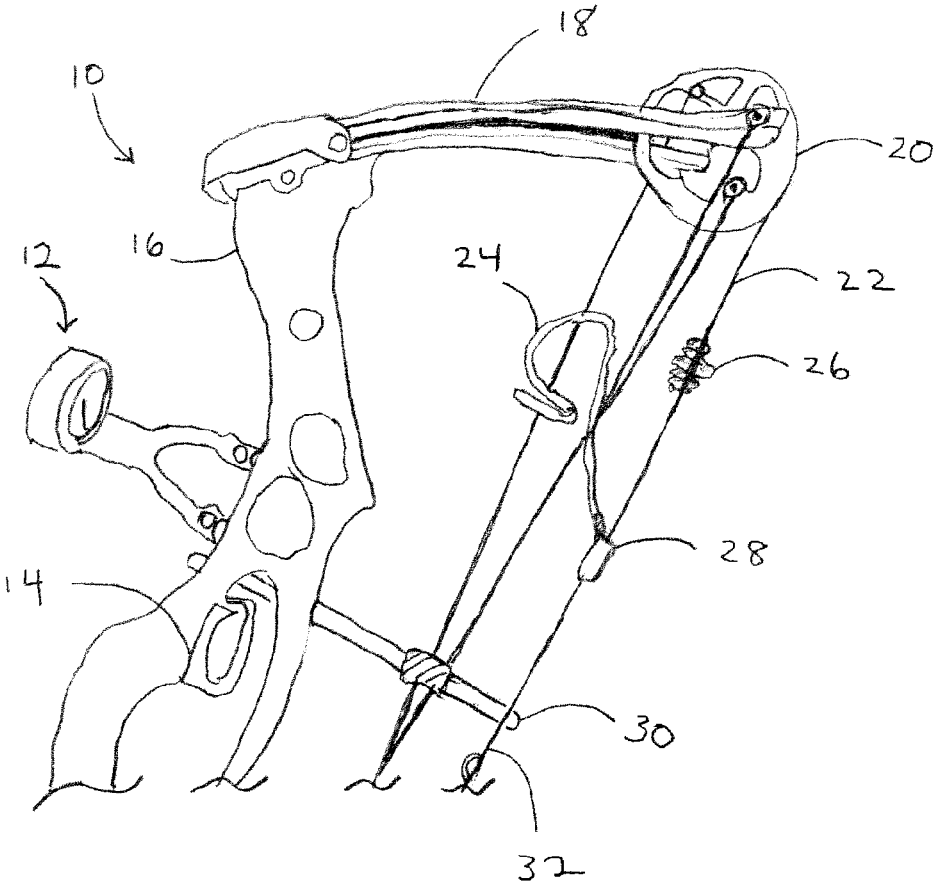
PRIOR ART FIG. 1

Archery peep sights are devices that mount onto a bowstring in order to improve sighting and aiming ability (see FIG. 1, peep sight 28). A peep sight is used analogously to the rear sight of a rifle, in that it creates a viewing line from the archer's eye to a forward sighting point used for aiming. Archers and hunters have long used peep sights on their bows to improve sighting and aiming. Vibration dampeners are also mounted on a bowstring by archers to reduce noise and other effects following a bowstring stroke (see FIG. 1, vibration dampener 26). A bowstring dampener, also known as bowstring silencer, reduces audible and inaudible oscillations in a bowstring after the arrow is released in a shooting stroke.

Figure 2:
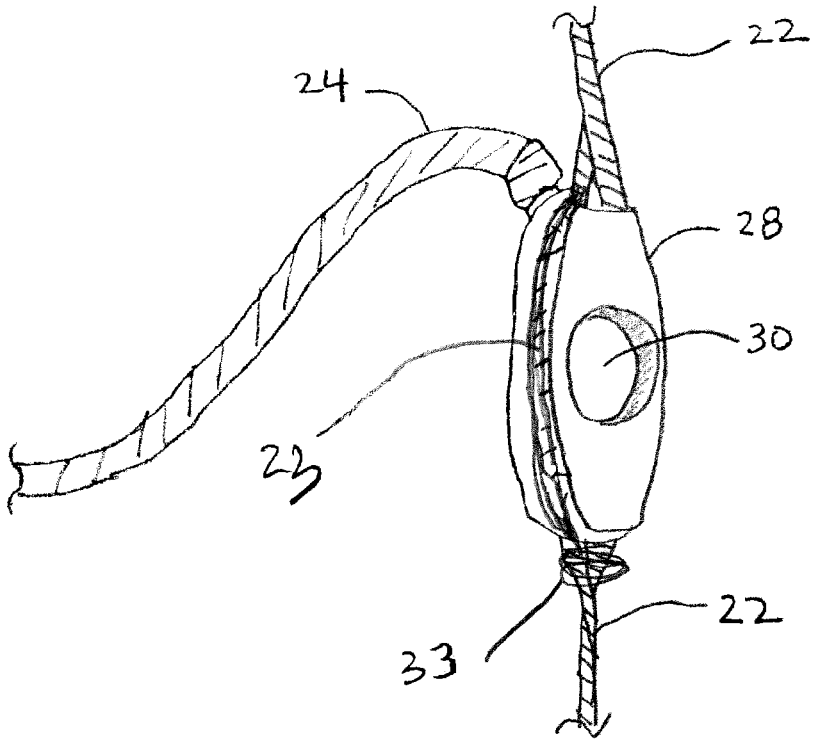
PRIOR ART FIG. 2
Figure 3:
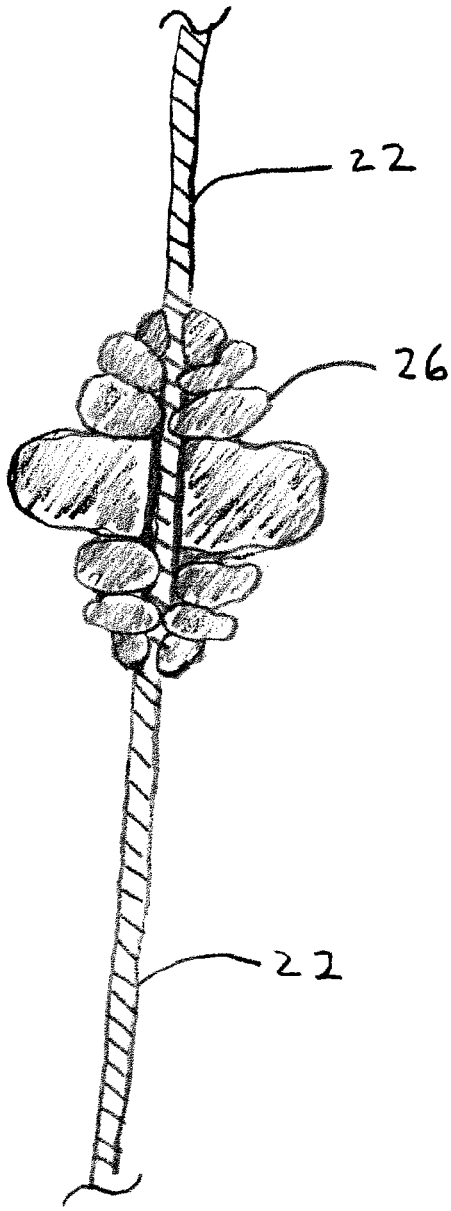
PRIOR ART FIG. 3

FIG. 2 shows an example of a conventional bowstring-mounted peep sight 28 in expanded size, and FIG. 3 further details an example of a conventional bowstring dampener 26 in expanded size.

The following United States patents are relevant to archery peep sights: Hutchins, in U.S. Pat. No. 295,252, discloses a stop comprising two adjoining hemispherical shells for attaching the stop to check-row wires.

McLendon, in U.S. Pat. No. 3,410,644, teaches a telescopic means for a bow wherein the target is magnified.

In U.S. Pat. No. 3,703,771 discloses an archery peep sight adapted for securement on a stranded bowstring.

Inventor Troncoso, in U.S. Pat. No. 4,656,747, teaches a bowstring peep sight that can be easily and securely connected to the bowstring of a compound or non-compound bow.

Saunders, in U.S. Pat. No. 4,965,938, teaches a peep sight for mounting on the bowstring of an archery bow. The peep sight is resistively and frictionally stably mounted on and coupled to the bowstring, yet readily, manually relocatable at selected positions along the bowstring.

In U.S. Pat. No. 5,542,186 is disclosed a peep sight device for mounting on the bowstring of an archery bow. The device is characterized in that it includes a skeletal ring and an interiorly-mounted transversely-extending frame. The frame demarks and defines a peep sight orifice.

U.S. Pat. No. 5,669,146 discloses a rear peep sight for use with an archery bow that has a sighting body with front and rear surfaces joined by a side surface and a mounting groove formed in the side surface for retaining the sighting body on a bowstring. A sighting aperture and a plurality of locator apertures extend from the rear surface to a bottom surface of a cavity in the sighting body.

U.S. Pat. No. 5,860,408 discloses a peep sight device for a bowstring includes a pair of interengaged inner and outer sections, with a sight hole surrounded by a peripheral surface having a degree of taper such that substantially about 120° of natural light is available to the sight hole on each of two opposite sides of the device.

U.S. Pat. No. 5,996,569, teaches a bowstring mounted rear peep sight comprising a transparent material, preferably acrylic.

U.S. Pat. No. 6,131,295 describes a rear sight that is adapted to be mounted on the bowstring of an archery bow having a front sight mounted on the bow. The rear sight includes a body adapted to be mounted on the string in a region which will generally be aligned with the user's eye when the string is drawn.

In U.S. Pat. No. 7,275,327 is described a bow sight system including a bow sight assembly adjustably mounted to a base plate. The bow sight can include a conventional forward sight, such as a pin sight and a V shaped rear sight. Sighting through the V shaped rear sight groove allows the archer to see the forward sight if the bow and archer are in proper alignment.

In summary, these patents describe a variety of peep sights, varying means of mounting peep sights, and means of sighting bows. None of these patents addresses vibration dampening as an improvement to the peep sight construction.

The need to dampen the vibrations in a bowstring upon firing has been a problem that bow shooters have contended with throughout the history of archery. Excessive vibrations can affect a bow's performance and create additional unwanted noise, and it is understood that such noise may make alert or frighten an animal target. To date this problem has been addressed by adding dampening devices that mount onto the bowstring, such as that shown FIG. 1 and FIG. 3, as a further accessory to a peep sight. Unfortunately the mounting of such accessories onto a bowstring reduces the net arrow speed because of the increased inertial mass of the bowstring and because of air-frictional losses created by the extra devices during a shot.

Even after many centuries of using archery peep sights, no one has heretofore combined the functions of dampening and sighting in one sight. It is believed that this failure was in part due to the lack of suitable materials of fabrication. However, the combination has recently become feasible because of the availability of advanced polymeric materials, that have now been novelly combined, as shown below, with new plastic processing and injection technologies such as "two shot molding" and "insert molding".

SUMMARY OF THE INVENTION

Disclosed in exemplary and non-limiting embodiments described herein are improved peep sight devices that integrally incorporate sighting and vibration dampening features. Such peep sights allow the archer to reduce the total number of devices mounted onto a bowstring and to reduce the resulting loss in arrow speed caused by lower bowstring speed. As with the vibration dampening devices, peep sights can also reduce the net arrow speed due to losses created by the peep sight. However, the prior art has shown peep sights and vibration dampening devices to be mutually exclusive devices, compounding the negative effects when both are present on a bowstring.

By combining in one embodiment of the instant invention the functionalities of dampening and sighting, fewer devices are needed on the bowstring. The combination reduces the net loss in arrow speed caused by extra devices mounted onto the bowstring, partly by reducing air friction, and partly by reducing the inertial mass of the combined device, compared to the uncombined accessories. Also, such an embodiment in part utilizes advantageously the surface friction achieved by placing a bowstring in direct contact with an elastomeric rubber surface to partly effect dampening and absorbtion of mechanical energy of the string.

In one non-limiting embodiment is disclosed a mechanical assembly attached to a bowstring that comprises integrally a sighting means for aiming a bow and a dampening means for dampening vibrations of the bowstring and bow after an arrow is discharged from the bow.

These and other aspects of the invention are described in greater detail below in FIG. 4A and FIG. 4B.

BRIEF DESCRIPTIONS OF DRAWINGS

FIGS. 1-3 are intended to assist in illustrating and defining conventional bow, dampener, and peep sight technologies.

FIG. 1 provides in perspective view one example of a conventional compound bow with peep site and dampener both mounted on the bowstring (or shooting string).

FIG. 2 illustrates in an expanded perspective view a conventional peep sight mounted or clamped on a bow-string.

FIG. 3 provides in expanded perspective view a conventional bowstring dampener.

Figure 4A:
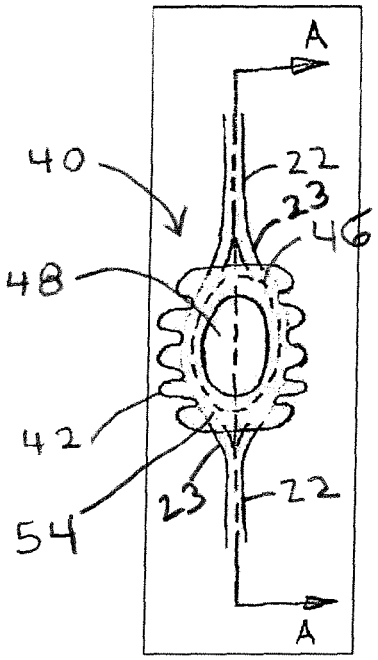

FIG. 4A discloses in perspective view an exemplary embodiment of the instant invention, integrally combining peep site and dampener means. FIG. 4B shows the embodiment in sectional view.

Figure 5A:
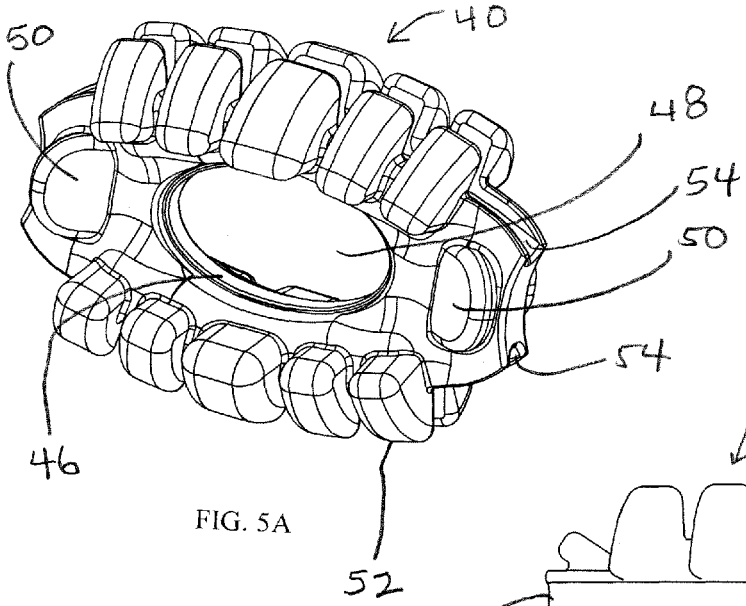
Figure 5B:
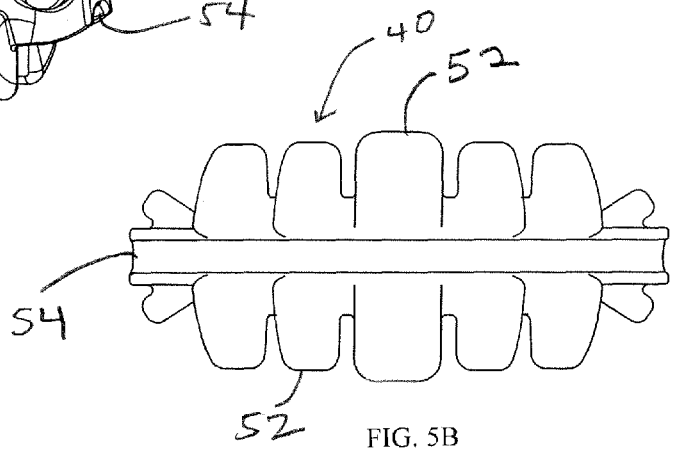
Figure 5C:
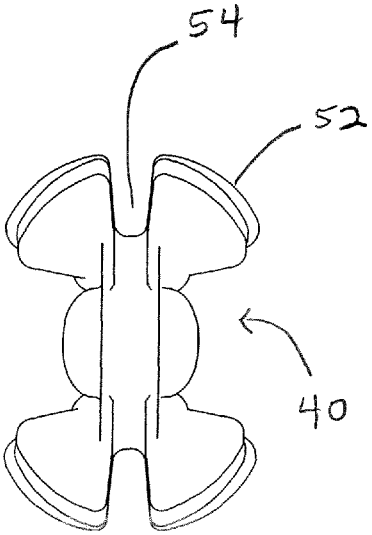
Figure 5D:
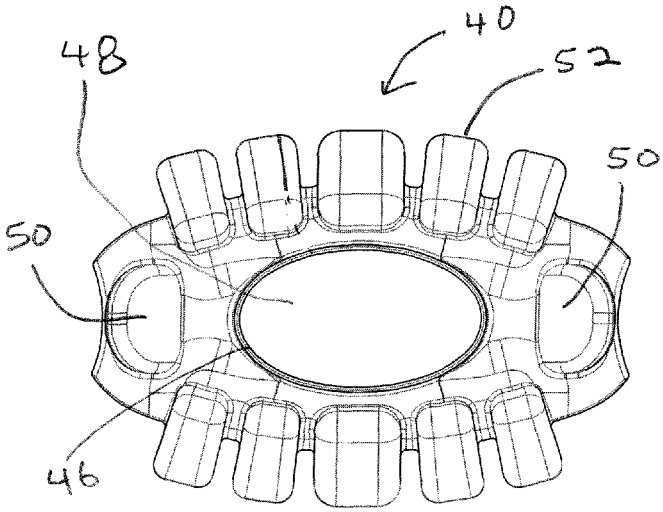

FIG. 5A provides in perspective view an exemplary embodiment of the invention. FIG. 5B provides in perspective side view an exemplary embodiment of the invention. FIG. 5C provides in perspective a bottom or top view an exemplary embodiment of the invention (as it might be mounted on a bowstring). FIG. 5D provides in perspective side view an exemplary embodiment of the invention.

DETAILED DESCRIPTION OF THE INVENTION

The term as used herein, "peep sight" is a rear sight for a bow, attached to the bowstring, similar to a rear sight on a gun, having a small hole through which to sight when aiming the bow.

A recurve bow is a bow that has tips that curve away from the archer when the bow is unstrung.

A compound bow is a modem bow that uses a levering system, usually of cables and pulleys, to bend the limbs of the bow.

A longbow is a type of bow that is tall (roughly equal to the height of a person who uses it), is not significantly recurved, and has relatively narrow limbs, The term "durometer" refers to a standard indenter device for measuring the hardness of a material as measured by resistance to permanent indentation. The term durometer is often used to refer to the measurement, as well as the instrument itself. The "Shore A" scale of relative hardness is the measurement obtained using the ASTM D2240 type A scale, that is adapted to softer plastics, whereby a measurement of 100 refers to no penetration of the test object by the indenter and a value of 0 refers to a penetration of 2.5 mm or greater into the test object.

The term "dampener" refers to a device that dampens or lessens the vibrations in a bow-string.

The term "elastomeric rubber" or "elastomer" or "elastomeric material" refers to any of various polymers or substances having the elastic properties of natural rubber, that typically can be stretched many times at room temperature while returning to their original shapes after stretching is halted. Two such examples of useful, commercially available elastomers are Versaflex® and Dynaflex®. One such specific example of an Versaflex elastomer is Versaflex®0 CL2242, possessing a Shore hardness (at 10 second delay) of 42 A as measured by a durometer.

A propylene homopolymer is a polymer constructed by chemically linking propylene monomers. One such specific exemplary commercial polymer, useful in the invention, is OnForce™ LFT PP-40 LGF/000 Natural.

Examples of prior art are demonstrated in FIGS. 1-3. Displayed in FIG. 1 is the upper segment 10 of a compound bow assembly, with front sight 12, arrow rest 14, riser 16, upper limb 18, cam assembly 20, bowstring 22, optional peep sight stabilizer 24, dampener 26, peep sight 28, cable guard 30, and nock point 32.

FIG. 2 illustrates in larger view a conventional peep sight 28 mounted between the strands of bowstring 22, with peep sight stabilizer 24 attached to peep sight 28. Annular opening 30 is the opening through which an archer sights through to front sight 12 toward a target. Peep sight serving 33, wrapped around the bowstring, stabilizes the peep sight on bowstring 22.

FIG. 3 illustrates in expanded view a conventional string vibration dampener 26 attached via a clamping fit to bowstring 22.

Figure 4B:
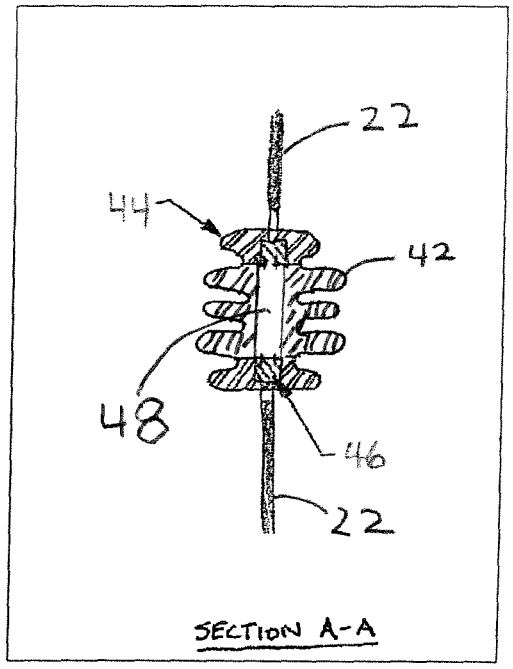

Shown in FIGS. 4A, FIG. 4B, and FIGS. 5A-5D are examples of the instant invention. As such, the example in FIGS. 4A and 4B provides in one non-limiting embodiment an integrally constructed peep sight and string dampener. The embodiment comprises a rigid peep sight ring 46, constructed with a rigid plastic, such as a propylene homopolymer, with elastomeric rubber material 42, conveniently shaped, to provide the dual function of sighting and vibration dampening within the peep sight. The dampening action is partly due to the favorable theological properties of the materials used to construct the peep sight, and the favorably allowed mechanical deformations of the elastomeric materials thereof.

FIG. 4A provides a front view of an embodiment of the device, an assembly 40, attached to a bowstring 22 by mounting between the bowstring strands, 23. Rigid ring 46, incorporated into the body of the elastomeric rubber 42, separates and is held in place by the separated strands of the bowstring. The function of rigid ring 46 is to maintain the annular opening 48 in its intended shape against the compressive forces applied by the bowstring. The bowstring may be divided and pass through channels 54. The rigid ring is constructed, for example, from a polypropylene homopolymer.

The archer sights roughly perpendicularly through the annular opening 48 toward the target through the front sight. In the case that 48 is oval, with its long axis vertical, 48 assumes a circular appearance from the archer's perspective as the bowstring is pulled back. FIG. 4B is a cross sectional view of 40 along section A-A. In this sectional view there is again shown a rigid ring 46, which fits between the bowstring strands and creates an opening 48 through which a shooter can sight a target when aligning with a front sight. Attached to the rigid ring is an elastomeric rubber material, 42, of mass, shape, and theological properties to provide in part the degree of dampening that is needed. This material can be bonded to the rigid ring by any means including mechanical, thermal and chemical.

FIG. 5 illustrates another exemplary embodiment of the invention. FIG. 5A again illustrates an assembly 40, with sighting opening 48, cutouts 50, "wings" 52, rigid ring 46, and bowstring channels 54. The cutouts 50 and "wings" 52 improve the aerodynamic performance of the peep sight and assist with dampening. FIG. 5B is a side perspective view of assembly 40, as oriented on its side. Shown are bowstring channels 54 and "wings" 52. FIG. 5C is a bottom or top perspective view of assembly 40. Shown are bowstring channel 54 and "wings" 52. FIG. 5D is a side perspective view of assembly 40, as oriented on its side, in a more flattened perspective that 5A. Shown are "wings" 52, rigid ring 46, cutouts 50, and sighting opening 48.

Opening 48 can be of any shape, including a circular and oval shapes. In the case of an oval shape, the long axis of the oval may range from about 2 mm (0.78 inch) to about 13 mm (0.5 inch). In the case of a circle, the diameter of the circle may range from about 1 mm (0.04 inch) to about 10 mm (0.40 inch).

The overall dimensions of the assembly 40 are such the height of the assembly is between about 13 mm (0.5 inch) and 38 mm (1.5 inch); the depth of the assembly is between about 8 mm (0.3 inch) and 16 mm (0.6 inch); and the width of the assembly is between about 6 mm (0.25 inch) and 25 mm (1.0 inch).

The dimensions of channel 54 are in the range of 0.8 mm (0.03 inch) to 2 mm (0.08 inch) at its widest point; and its depth is in the range of 0.5 mm (0.02 inch) to 1.5 mm (0.06 inch).

The construction materials of the assembly are not limited to elastomeric rubbers and polypropylene polymers. For example, other materials than an elastomeric rubber, such as plastics and/or metals, may be used instead of the rubber comprising assembly 40.

Stabilizing devices that prevent rotation of assembly 40 on the bowstring (as the bowstring comes under tension during use) may be optionally attached to assembly 40, but are not required.

The attachment of assembly 40 to the bowstring is not limited to attachment between the strands of the bowstring.

The invention may be applied to any bow type or bowstring. Three exemplary types of bows are compound bows, recurve bows, and longbows.

During the process of shooting an arrow with a bow, the string is released from its potential energy state position. As it moves forward energy is transmitted from the bowstring to the arrow. When the arrow disengages from the bowstring there remains some kinetic energy in the bowstring and bow. This energy deforms the bow and thereby creates unwanted noise as the bow and bowstring system vibrate. The elastomeric material in the disclosed embodiments absorbs a portion of this energy because of its elastomeric and theological properties. A typical durometer of the elastomeric rubber for constructing the embodiment disclosed could range from about 10 Shore A to about 70 Shore A.

An added benefit of the invention is the frictional resistance that occurs between the bowstring strands and the surfaces of the peep sight, in one example, side channels of the peep sight, that are elastomeric material (rubber). This elastomeric material minimizes the movement of the device within the string channels in assembly 40. It should be noted that any movement of the device would affect the targeting ability of the shooter, therefore minimal movement is desired.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

STATEMENT REGARDING EMBODIMENTS

While the invention has been described with respect to embodiments, those skilled in the art will readily appreciate that various changes and/or modifications can be made to the invention without departing from the spirit or scope of the invention as defined by the appended claims. All documents cited herein are incorporated by reference herein where appropriate for teachings of additional or alternative details, features and/or technical background.

What is claimed is:

1. A mechanical assembly configured to be attached to an archery bowstring that comprises:

a peep sight portion formed of a rigid first material comprising a rigid ring defining a sighting opening, said rigid ring further defining a plane;

a dampener portion formed of an elastomeric second material and integrated to an outer surface of said peep sight portion, said dampener portion comprising two opposing bowstring channels lying in said plane.

2. The mechanical assembly of claim 1 wherein a plurality of prominent wings define said two opposing bowstring channels.

3. The mechanical assembly of claim 2 wherein said plurality of prominent wings are segmented by a plurality of latitudinal channels each normal to said plane thereby forming multiple flexible nodules.

4. The mechanical assembly of claim 1 wherein said rigid first material has a hardness ranging between approximately 40 to 150 Rockwell R.

5. The mechanical assembly of claim 1 wherein said elastomeric second material is characterized by a durometer of approximately 20 to 60 Shore A.

6. The mechanical assembly of claim 1 that is configured for attachment between strands of the bowstring.

7. The mechanical assembly of claim 1 wherein said sighting opening is circular.

8. The mechanical assembly of claim 1 wherein said sighting opening is oval.

9. The mechanical assembly of claim 1 wherein surfaces of said two opposing bowstring channels comprise said elastomeric material.

* * * * *